United States Patent [19]

Senn et al.

[11] Patent Number: 4,644,979

[45] Date of Patent: Feb. 24, 1987

[54] HEDDLE DRIVE FOR A WEAVING MACHINE

[75] Inventors: Georg Senn; Herbert Oberholzer, both of Ruti, Switzerland

[73] Assignee: Sulzer Brothers Limited, Winterthur, Switzerland

[21] Appl. No.: 727,539

[22] Filed: Apr. 26, 1985

[30] Foreign Application Priority Data

May 15, 1984 [EP] European Pat. Off. ..... 84810238.0

[51] Int. Cl.[4] ..... D03C 13/00

[52] U.S. Cl. ..... 139/82; 139/89

[58] Field of Search ..... 139/82, 83, 84, 91

[56] References Cited

FOREIGN PATENT DOCUMENTS 2131671 2/1973 Fed. Rep. of Germany ..... 139/82

2524503 10/1983 France ..... 139/82

233156 7/1944 Switzerland ..... 139/84

628498 8/1949 United Kingdom ..... 139/29

*Primary Examiner*—Werner H. Schroeder

*Assistant Examiner*—Joseph S. Machuga

*Attorney, Agent, or Firm*—Kenyon & Kenyon

[57] ABSTRACT

The heddle drive is coupled to the transverse beam of the heddle so that the path of movement of the heddle and the direction in which the drive force is applied run parallel to each other. As a result, the transverse beams need not be especially strong. Further, the longitudinal beams may be constructed in a light weight manner since no drive forces are transmitted to these beams. The resulting heddle has a relatively small mass and the drive is especially suitable for high speed weaving machines.

12 Claims, 5 Drawing Figures

HEDDLE DRIVE FOR A WEAVING MACHINE

This invention relates to a heddle drive for a weaving machine.

Heretofore, various types of drives have been used in weaving machines for driving a heddle. For example, Swiss Pat. No. 623,364 describes a heddle which is formed of longidutinal beams and transverse beams as well as a drive mechanism which consists of a linkage which engages at the lower longitudinal beam of the heddle. As described, the linkage contains, for example, two sinkers which are moved up and down with each having a hook at the upper end for engaging with a matching lug provided in the lower longitudinal beam of the heddle. As such, a mechanical coupling of the drive mechanism to the heddle exists at the lower longitudinal beam of the heddle.

In constructions of the above type, the heddle must be provided with especially heavy longitudinal beams in order to transmit the drive forces introduced into the longitudinal beam. Hence, the heddle has a correspondingly high mass which must be moved back and forth. However, for high speed weaving machines, for example, machines operating at 400 cycles per minute, and more, this type of drive is not suitable because of the continuous acceleration and deceleration of the heddle masses.

Accordingly, it is an object of the invention to provide a simplified drive for a heddle of a weaving machine.

It is another object of the invention to permit the use of relatively light weight heddles in a weaving machine.

Briefly, the invention provides a combination of a heddle including at least one transverse beam and means coupled to the beam for reciprocating the heddle in a path parallel to the beam. Thus, during operation, the drive motion and drive force from the reciprocating means is introduced into the transverse beam of the heddle. As a result, the driving and braking forces of the reciprocating means always run parallel to the length of the transverse beam during operation.

Because the drive motions and drive forces are introduced in parallel relation to the transverse beam of the heddle, the beam is not subject to bending stresses and may be relatively weak. As a result, the entire heddle may be relatively light in weight. For this reason, the reciprocating means is especially suitable for high speeds, for example in weaving machines having a pneumatic insertion.

In order to further achieve the introduction of the drive forces in parallel to the transverse beam, use is made of a dynamic coupling between the reciprocating means and the transverse beam. To this end, the reciprocating means is provided with a rail in which a serration is provided along one side while the transverse beam is provided with an attachment or shoulder which is likewise provided with a serration along one side to mate with the serration of the rail. In addition, a collet or other means is secured to the rail and the shoulder for mutual reciprocation. In this way, joints between the reciprocating means and the heddle beam can be avoided to a large extent.

In addition, the heddle may be made with longitudinal beams of relatively light weight so that these beams contribute a relatively small share to the total mass of the heddle.

These and other objects and advantages of the invention will become more apparent from the following detailed description taken in conjunction with the accompanying drawings wherein:

FIG. 1 schematically illustrates a part of a weaving machine employing a drive means in accordance with the invention;

Figure 1:
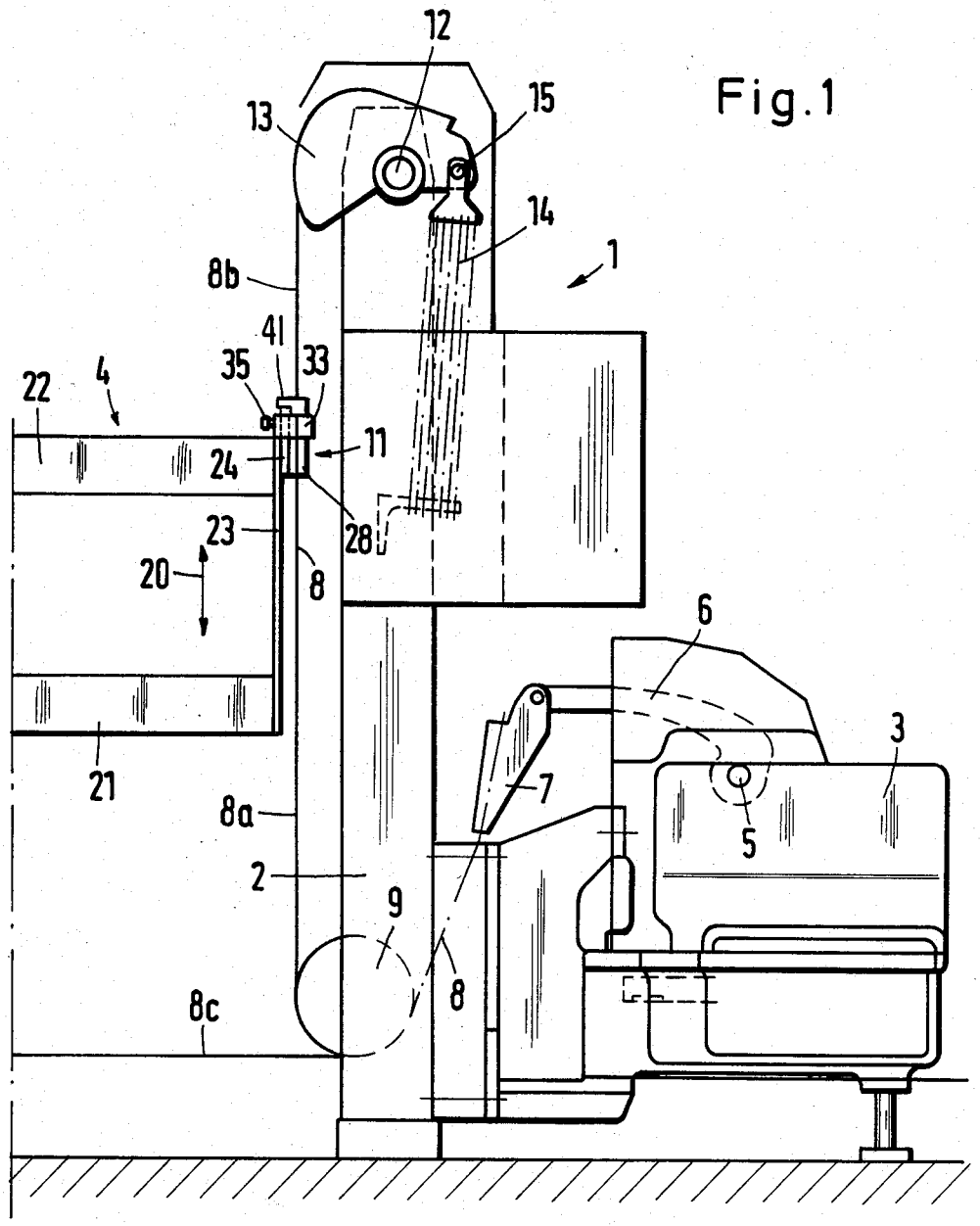

Referring to FIG. 1, the weaving machine 1 is of a type such as a pneumatic insertion machine and contains a machine frame 2, a heddle driving machine 3, for example an eccentric or card dobby and several heddles 4 (only one of which is shown in FIG. 1).

The driving machine 3 includes a drive means for reciprocating each respective heddle 4. As indicated, each drive means includes a drive lever 6 which is pivotally mounted about a pivot 5, a traction clamp 7 which is articulated to the lever 6 and a cable 8 which is clamped to the traction clamp 7 and which consists of two sections 8*a*, 8*b*. As indicated , the cable 8 is guided over a fixed roller 9 to a point 11 at which the cable is coupled to the heddle 4. At the upper end, as viewed, the cable 8 is passed over an arched rocker 13 which is pivotally mounted on a pivot axis 12 and is secured to the rocker 13. A tension spring 14 engages the rocker 13 at one end 15 and biases the rocker 13 to rotate in a clockwise manner as viewed in FIG. 1, i.e. in a direction away from the driving mechanism formed, in part, by the drive lever 6.

During operation, the heddle 4 is moved downwardly, as viewed in FIG. 1, under the downward pulling force of the cable section 8*a* and is moved upwardly via the cable section 8*b* under the force of the tension spring 14.

Referring to FIG. 1, the heddle 4 contains two longitudinal beams 21, 22 which are connected by transverse beams 23, only one of which is shown in FIG. 1.

Figure 2:
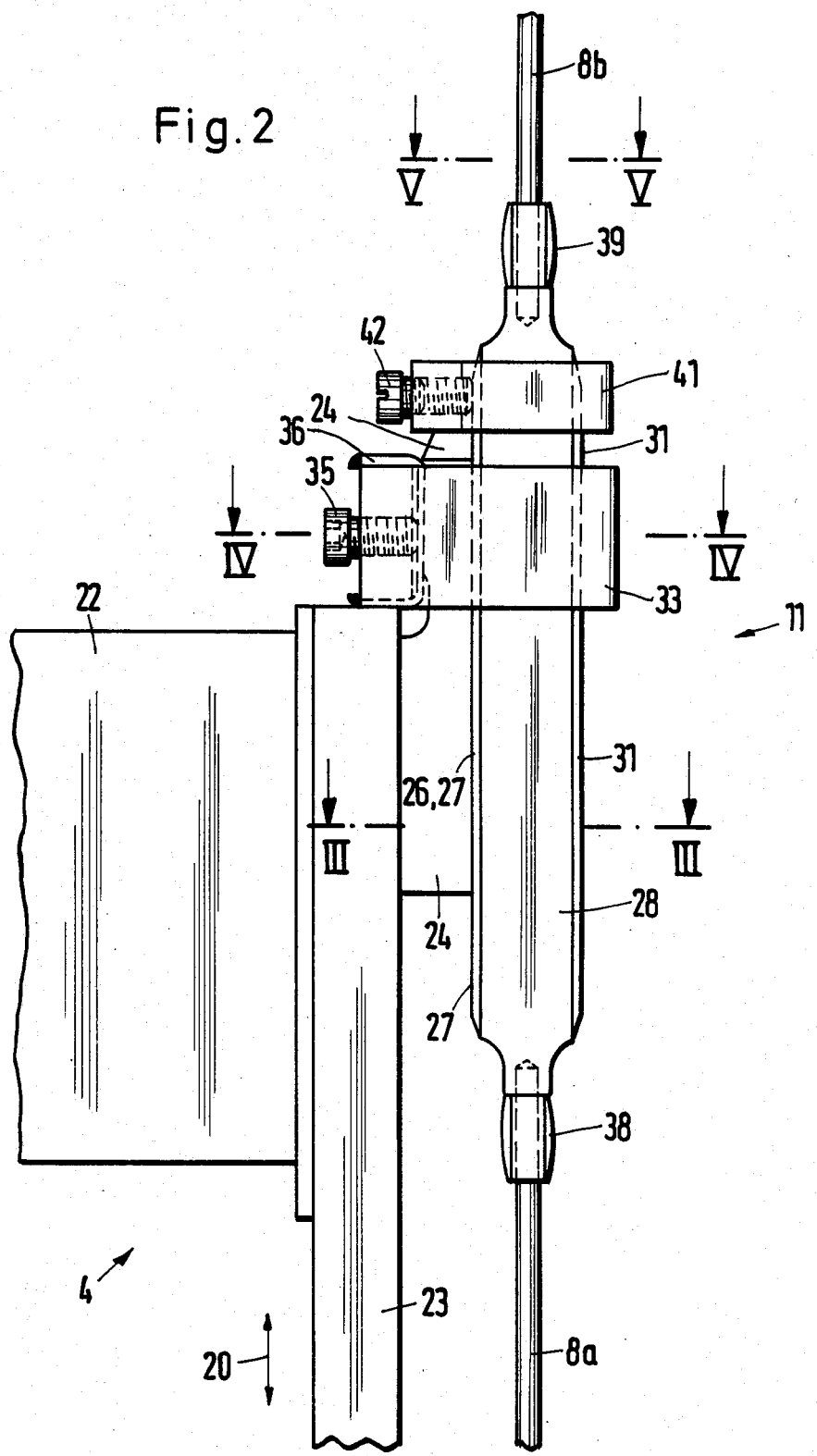
FIG. 2 illustrates an enlarged view of a part of the drive means as coupled to the heddle frame in accordance with the invention.
Figure 5:
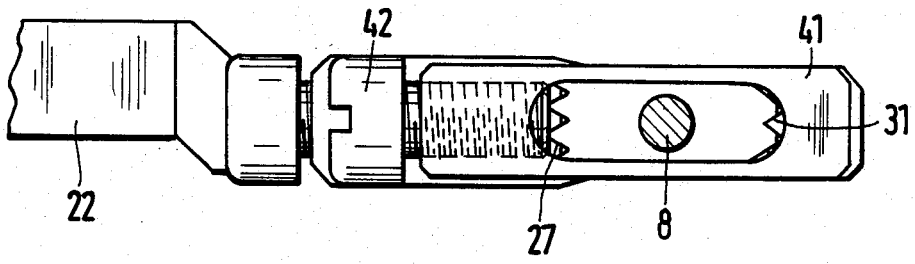
FIG. 5 illustrates a view taken on line V—V of FIG. 2.
Figure 3:
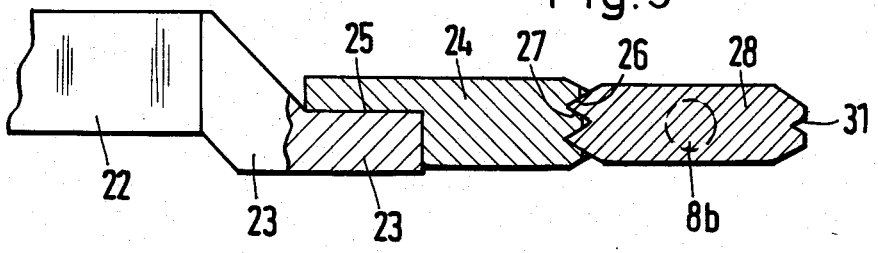
FIG. 3 illustrates a view taken on line III—III of FIG. 2.

Referring to FIG. 2, the drive means is coupled to the transverse beam 23 at the point 11 in order to reciprocate the heddle 4 in a path parallel to the transverse beam 23, i.e. in the direction indicated by the arrow 20. To this end, the transverse beam 23 is provided with a shoulder or attachment element 24 at the upper end, as viewed, in the plane of the upper longitudinal beam 22. This shoulder 24 may be secured to the transverse beam 23 e.g. by soldering along a surface 25 as indicated in FIG. 3 or may be made integral with the transverse beam 23. Further, as indicated in FIG. 3, the shoulder 24 is provided with a serration 26 which extends along one side parallel to the motion path followed by the transverse beam 23.

The drive means includes a rail 28 parallel to the transverse beam 23 and the shoulder 24. This rail 28 is also provided with a serration 27 along one side which faces and which engages in the serration 27 of the shoulder 24. In addition, as indicated in FIG. 3, the rail 28 has a further serration 31 on the opposite side which extends parallel to the path of reciprocation of the heddle 4 in order to receive a counter-serration 32 of a collet 33 which acts as a means to secure the rail 28 to the shoulder 24. To this end, the collet 33 receives a screw 35 which serves to press the rail 28 and shoulder 24 into clamped relationship upon tightening of the screw 35 in the collet 33. As indicated in FIGS. 2 and 4, a U-shaped pressure piece 36 is provided between the screw 35 and the shoulder 24 on the beam 23 to protect the shoulder 24 from being damaged by the screw 35.

Referring to FIG. 2, the rail 28 is clamped to the lower cable section 8*a* via a suitable clamping member 38 while the upper cable section 8*b* is coupled to the upper end of the rail 28 by a similar clamping element 39. In addition, a stop means in the form of a sleeve 41 is disposed about the upper end of the rail 28 above the collet 33. This sleeve 41 is provided with a tightening screw 42 which serves to engage against the rail 28. The screw 42 also permits the sleeve 41 to be moved along the length of the rail 28 so as to permit adjustment relative to the shoulder 24 of the heddle 14.

Figure 4:
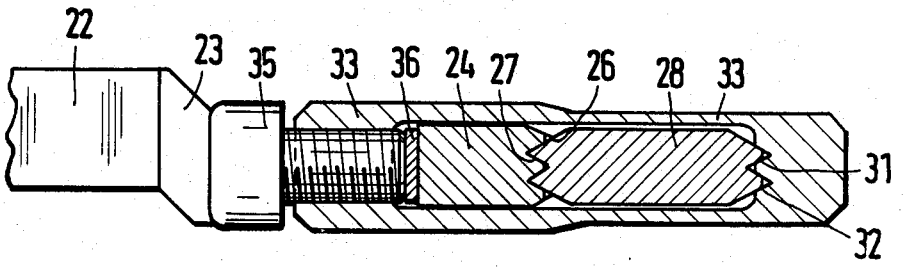
FIG. 4 illustrates a view taken on line IV—IV of FIG. 2.

As indicated in FIGS. 2 and 4, the serrations 26, 27; 31, 32 between the shoulder 24, rail 28 and collet 33 permit the drive or braking force passed by the cable 8 to the coupling point 11 to be introduced in parallel to the motion of the heddle 4 as indicated by the double arrow 20 in the form of a dynamic ("force-locking") movement transmission.

Of note, the heddle 4 can be coupled to the rail 28 continuously along the serration 27.

The transverse beam (not shown) on the opposite side of the heddle 4 may be coupled to the drive means via a cable 8*c* so that the heddle 4 can be driven at both transverse beams 23. As indicated, the cable 8*c* also passes over the fixed roller 9 so as to be moved via the drive mechanism formed, in part, by the drive lever 6.

In most weaving machines, the movement direction of the heddle 4 is up and down in a vertical plane. Further, the longitudinal beams 22 are generally much longer than the transverse beams 23. Further, both ends of the longitudinal beams 21, 22 usually have transverse beams 23 secured thereto. In addition, for a large weaving width, transverse beams may also be provided at intermediate points in the form of intermediate struts.

The invention thus provides a relatively simple drive means which can be dynamically coupled to a heddle for reciprocating the heddle in a simple manner.

Further, the invention permits the use of a light weight heddle since the drive forces are imposed on a transverse beam of the heddle.

What is claimed is:

1. In a weaving machine, the combination comprising a heddle including a pair of longitudinal beams and a pair of transverse beams; and means coupled to at least one of said transverse beams for reciprocating said heddle in a path parallel to said one transverse beam, an adjustable stop in said means, said stop further provides adjustment of said heddle relative to said means along said path.

2. The combination as set forth in claim 1 which further comprises a shoulder secured to said one transverse beam in the plane of one of said longitudinal beams, said means being coupled to said shoulder.

3. The combination as set forth in claim 2 wherein said means includes a rail parallel to said shoulder and said one transverse beam, a collet clamping said rail to said shoulder and a cable secured to said rail for reciprocating said rail in said path.

4. The combination as set forth in claim 2 wherein said shoulder includes a first serration parallel to said path and said means includes a second serration mating with said first serration.

5. The combination as set forth in claim 4 wherein said means includes a rail having said second serration therein and a collet surrounding said rail and said shoulder to hold said serrations in mating relation.

6. The combination as set forth in claim 5 wherein said collet and said rail include mating serrations therein parallel to said path.

7. In combination, a heddle including at least one transverse beam; and drive means coupled to said beam for reciprocating said heddle in a path parallel to said beam, said drive means including a rail parallel to said beam, a collet for securing said rail to said beam and means secured to said rail to reciprocate said rail parallel to said path.

8. The combination as set forth in claim 7 wherein said means to reciprocate said rail includes a first cable section secured to one end of said rail, a driving mechanism secured to said cable section to pull said rail in one direction in said path, a second cable section secured to an opposite end of said rail and a spring secured to said second cable section to bais said rail away from said driving mechanism.

9. The combination as set forth in claim 7 which further comprises a shoulder integral with said beam and in mating relation with said rail within said collet.

10. In a weaving machine, the combination comprising a heddle including a pair of longitudinal beams and a pair of transverse beams;

a shoulder secured to at least one of said one transverse beams in the plane of one of said longitudinal beams and having a first serration; and means coupled to said shoulder for reciprocating said heddle in a path parallel to said one transverse beam, said means including a second serration mating with said first serration and being parallel to said path.

11. The combination as set forth in claim 10 wherein said means includes a rail having said second serration therein and a collet surrounding said rail and said shoulder to hold said serrations in mating relation.

12. The combination as set forth in claim 10 wherein said collet and said rail include mating serrations therein parallel to said path.

* * * * *